United States Patent [19]

Perry et al.

[11] Patent Number: 4,988,105

[45] Date of Patent: Jan. 29, 1991

[54] METHOD AND COURSE FOR PLAYING A GOLF-LIKE GAME

[76] Inventors: Ralph Perry, 5731 Pine Acres La., Roanoke, Va. 24014; Edgar N. Weaver, Jr., 2502 Stanley Ave., SE., Roanoke, Va. 24014

[21] Appl. No.: 357,016

[22] Filed: May 23, 1989

Related U.S. Application Data

[62] Division of Ser. No. 97,640, Sep. 16, 1987, Pat. No. 4,928,973.

[51] Int. Cl.[5] ..... A63B 67/02

[52] U.S. Cl. ..... 273/176 A; 273/176 AB

[58] Field of Search ..... 273/176 R, 176 A, 176 AA, 273/176 AB; D21/18, 27

[56] References Cited

U.S. PATENT DOCUMENTS

| | | | |
|---|---|---|---|
| 1,851,423 | 3/1932 | Ely | 273/176 A |
| 2,003,074 | 5/1935 | Gage | 273/176 A |
| 2,482,210 | 9/1949 | Reach, Sr. et al. | 273/176 A |
| 2,577,690 | 12/1951 | Reach | 273/176 A |
| 3,083,021 | 3/1963 | Reilly | 273/176 AB |
| 3,129,943 | 4/1964 | McKee | 273/176 A |
| 3,350,099 | 10/1967 | Smart | 273/176 A |
| 3,464,703 | 9/1969 | Vallas | 273/176 A |
| 3,599,980 | 8/1971 | Harmond | 273/176 A |
| 3,620,536 | 11/1971 | Lau | 273/176 A |
| 3,649,027 | 3/1972 | Vallas | 273/176 A |
| 3,695,619 | 10/1972 | Brobston | 273/176 A |
| 3,904,209 | 9/1975 | Thomas | 273/176 A |
| 4,019,748 | 4/1977 | Healey | 273/176 A |
| 4,063,738 | 12/1977 | Michalson | 273/176 A |
| 4,145,053 | 3/1979 | Healey | 273/176 A |
| 4,192,510 | 3/1980 | Miller | 273/176 A |
| 4,288,056 | 8/1981 | Miller | 273/176 A |
| 4,572,512 | 2/1986 | Tegart | 273/176 A |
| 4,696,474 | 9/1987 | Tegart | 273/176 A |

FOREIGN PATENT DOCUMENTS

| | | | |
|---|---|---|---|
| 664701 | 3/1988 | Switzerland | 273/176 A |

*Primary Examiner*—Edward K. Look
*Assistant Examiner*—Thomas Denion
*Attorney, Agent, or Firm*—Mason, Fenwick & Lawrence

[57] ABSTRACT

A novel golf playing field for a golf-like target game. Although the playing field incorporates many of the features of standard golf including golf clubs, golf balls, a fareway, teeing areas, a sand trap, a putting green and target greens, the present invention is not an attempt to faithfully simulate a standard round of golf. Basically, the invention includes a playing field comprising a course with a fareway and a plurality of target greens positioned thereon in a predetermined pattern. At one end of the course is an expanded teeing area providing both practice and playing tees. Positioned on one side of the teeing area is a putting green. Positioned on the other side of the teeing area is a combination sand trap and target green. A special target green is positioned on the faraway a pre-set distance from the teeing area and acts as a pitching green under a specific set of rules. Several differently colored yardage markers are provided on the fareway. The color of each marker is used to designate a target based on a player's skill level. Depending on the par value of the hole being played and the outcome of a player's strokes, a player will be hitting to either a colored yardage marker, a target green, or the pitching green. Putting is done exclusively on the putting green adjacent the teeing area.

19 Claims, 2 Drawing Sheets

METHOD AND COURSE FOR PLAYING A GOLF-LIKE GAME

This application is a division of application Ser. No. 097,640, filed Sept. 16, 1987, now U.S. Pat. No. 4,928,973.

FIELD OF THE INVENTION

The present invention relates generally to golf and, more particularly, to a new course concept and method of playing golf.

BACKGROUND OF THE INVENTION

Because of the increasing popularity of golf, more golf courses are needed to meet the playing demands of the growing number of golfers. While at first glance the construction of additional golf courses seems a ready solution to accommodate the vast numbers of new golfers, the answer is not so easily reckoned. Standard golf courses require large amounts of land which is scarce and costly, particularly if the land is sought in a metropolitan area. Even if suitable land can be found, the high costs of constructing and maintaining a standard golf course, render the return on investment for a golf course very low.

In appreciation of the costly land requirements for the construction of standard golf courses, one response is to build golf courses on rural or farm lands further away from metropolitan areas. However, golf courses located great distances from metropolitan areas add unnecessary travel time to the time already required to play a round of golf. Golfers may well be reluctant or unable to devote such additional time to a game which already requires typically four hours to play on weekdays and up to six hours of playing time on weekends. Another attempt to meet the golfing demand and overcome the obstacle of costly and scarce land has been to design compact golf courses which simulate a round of standard golf.

U.S. Pat. No. 2,003,074 (Gage) discloses a golf playing field with the primary object of providing facilities for playing a game of golf within the limits of a relatively small tract of ground, but without materially detracting from the enjoyment of the game or eliminating the varied conditions of play that characterize the game as played on regulation courses.

U.S. Pat. No. 3,649,027 (Vallas) relates to a golf course that provides a means for playing a full 18 holes of golf without leaving a highly confined area and within the one confined area to always have a standardized condition. The course includes three different groups of targets, all of which are approximately the same size. The targets of the first group approximate a golf green and consist of grass. The targets of the second group resemble conventional golf greens but are areas of water surrounded by grass. The targets of the third group are entirely comprised of water.

U.S. Pat. No. 3,685,832 (Johnson) relates to a method of playing a golf game in an area much smaller than that devoted to a normal golf course. The game is characterized by the inclusion of teeing areas which are located intermediate between target greens and a chipping and putting area.

U.S. Pat. No. 4,572,512 (Tegart) is another example of a compact golf course which employs a number of tee positions facing a series of targets. Chipping greens and putting greens are also provided.

U.S. Pat. No. 4,063,738 (Michalson) is another example of a compact golf course which tries to simulate a conventional 9-hole course. The same may be said with respect to U.S. Pat. No. 4,129,300 (Magnuson).

SUMMARY OF THE INVENTION

The present invention relates to a novel golf playing field and a novel method of playing a golf-like game. Although the playing field and method incorporate many of the features of standard golf including golf clubs, golf balls, a fairway, teeing areas, a sand trap, a putting green and target greens, the present invention is not an attempt to faithfully simulate a standard round of golf. Rather, an embodiment of the present invention presents a new concept in golf and is very definitely a different game from regular golf, while retaining the most enjoyable aspects of the game of golf.

Basically, the invention includes a playing field comprised of an elongated course with a plurality of target greens positioned thereon in a predetermined pattern. At one end of the course is an expanded teeing area providing both practice and playing tees. Positioned on one side of the teeing area is a putting green. Positioned on the other side of the teeing area is a combination sand trap and target green. A special target green, designated a black green, is positioned on the course a pre-set distance from the teeing area and acts as a pitching green under a specific set of rules. Several differently colored yardage markers are provided on and help define the fairway. The color of each marker is used to designate a target based on a player's skill level.

Depending upon the par value of the hole being played and the outcome of a player's strokes, a player will be hitting to either a colored yardage marker on the fairway, a target green or the black green. Eventually a player will be putting for a hole which is done exclusively on the putting green adjacent the teeing area. Failure to meet certain goals requires the addition of one or more penalty strokes onto a player's score. The method of play provided by the present invention allows a player to remain nearly stationary since all shots to the playing field are taken from the teeing area or the nearby sand trap. In addition, there is no necessity of taking complicated distance measurements since a player needs only keep score of the number of strokes taken on the playing field and the number of strokes taken on the putting green. A special scorecard is provided to record a player's strokes.

Regarding expense, the actual land requirement to practice a preferred embodiment of the invention approximates only 12 acres. The compact size of the course makes land availability for the invention much greater than that required for a regular course. In fact, the preferred embodiment of the invention can be adapted to almost any existing driving range. Second, financing and construction costs are all substantially reduced by the compact course size. Further savings are incurred since the preferred embodiment of the invention does not require the expenses associated with multiple putting greens, ponds, traps and roughs. These savings make the invention an attractive alternative to smaller communities, educational institutions, retirement homes, etc., who are unable to afford a standard golf course. Basically, the present invention is attractive to all communities with overcrowded courses who are looking for less expensive alternatives to satisfy the growing demand for golf.

The invention is an attractive sport to many who previously found regular golf impractical because, for example, they were unable to walk great distances and were unable or did not wish to use golf carts. Players will also find advantages from the fact that they can play a varied round of golf without ever being more than a few hundred feet from shelter, telephone, bathroom and concession facilities.

Thus, it is a primary object of the present invention to provide a satisfying alternative to conventional golf which is less expensive and more attractive to golfers.

It is another object of the present invention to reduce the time expended by golfers in a standard game of golf in walking, riding carts, searching for lost balls and waiting.

It is yet another object of the present invention to provide a novel golf playing field incorporating many of the features of standard golf while providing a new concept of golf play that retains the most enjoyable aspects of the game of golf.

It is still another object of the present invention to provide a golf playing field and method which requires a player to travel minimum distances during the course of playing a game.

Further objects and advantages as well as features and details of the present invention are apparent from the accompanying drawings, specification and claims.

DETAILED DESCRIPTION OF THE PREFERRED EMBODIMENTS

Figure 1:
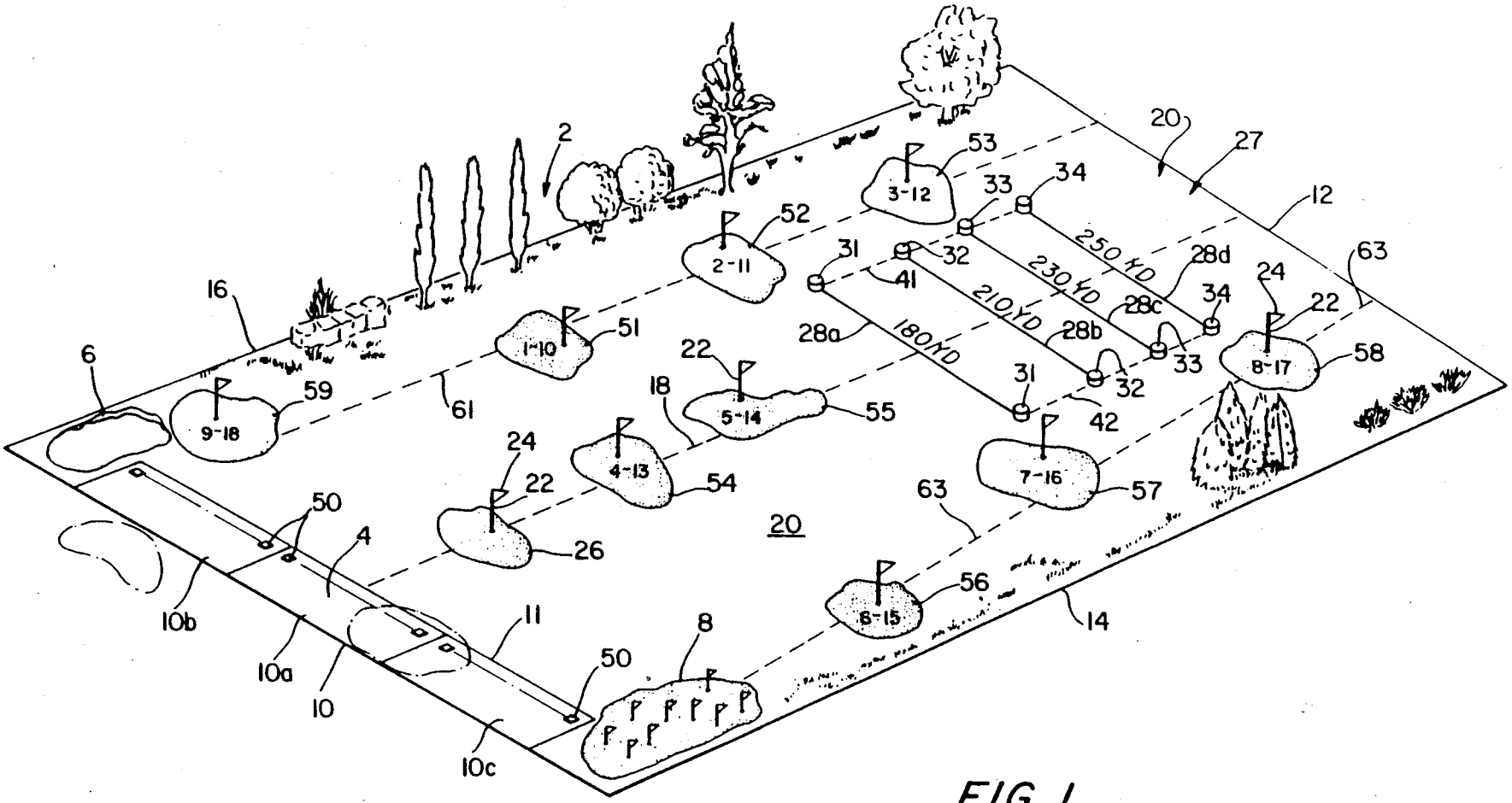
FIG. 1 is a diagrammatic perspective view of a playing field incorporating the teachings of the present invention.

FIG. 1 shows a diagrammatic aerial view of a playing field generally designated as 2. As oriented in FIG. 1, the elongated playing field is defined by four peripheral boundaries which generally form a rectangle. The peripheries are designated as a bottom line border 10, a top line border 12, a right line border 14 and a left line border 16. The bottom and top line borders are substantially parallel to one another and the right and left line borders are likewise substantially parallel to one another and perpendicular to the bottom and top line borders. It is to be understood that the playing field may take on alternative shapes depending on the available land mass. The primary requirement is that sufficient clear land be provided to accommodate the various structural elements forming part of the playing field. A fictitious longitudinal axis 18 through the playing field provides a further point of reference for explaining the structural arrangement of the field.

Defined on the playing field is an elongated open area referred to as the course 20. The course is that parcel of the playing field which contains a fairway 27, target greens 51–59, a putting green, a sand trap 6 and teeing area 4. The course is approximately 300 yards in length as measured along the longitudinal axis 18. The fairway 27 is a strip of land which is wider than an average standard fairway found on a conventional golf course but is shorter in length than such a fairway in that its proximal boundary begins some distance from the teeing area. Positioned predetermined distances along the longitudinal axis of this fairway are four distance or yardage markers **28*a*–28*d*. Each marker, is generally perpendicular to and centered on the longitudinal axis of the course. A unique color post 31–34 is positioned at each end of each marker. These posts and imaginary lines 41 and 42 extending through them serve as the lateral boundaries of the fairway. A yellow course distance marker 28*d* is placed about 250 yards forward of tee line border 11 which defines the front teeing area 4; a blue course distance marker 28*c* is placed about 230 yards forward of tee border 11; a white course distance marker 28*b* is placed about 210 yards forward of tee border 11; and a red course distance marker 28*a* is placed about 180 yards forward of the tee border 11**. This shortest marker represents the boundary of the fairway nearest to the teeing area. The reason for the various distance markers will be explained hereinafter in the context of how the game is played. Suffice to say at this point that these yardage markers are supplied as a way of taking into account the different skill levels possessed by various players.

Also defined on the course 20 are nine target greens 51–59 and a pitching green 26. Each target green is of a unique shape most nearly approximating the irregular circular or oval shape commonly associated with a golf green. Each of the target greens include a flagstick 22 with a flag 24 that contains numerical designations for two golf holes. Preferably, the flagsticks are positioned at or near the center of each target green. Target green 51 provides a target for Holes 1 and 10. Target green 52 corresponds to Holes 2 and 11. Target green 53 corresponds to Holes 3 and 12. Target green 54 corresponds to Holes 4 and 13. Target green 55 corresponds to Holes 5 and 14. Target green 56 corresponds to Holes 6 and 15. Target green 57 corresponds to Holes 7 and 16. Target green 58 corresponds to Holes 8 and 17. Target green 59 corresponds to Holes 9 and 18.

The widest point of the course as measured perpendicular to the longitudinal axis 18 is that portion adjacent to the bottom line border 10. The course at this point is approximately 150 yards wide. Moving in a direction toward the top line border 12, the course narrows to a width of 100 yards at approximately 250 yards forward of the teeing area 4. The approximate degree of convergence of the course is defined by the location of the six target greens 51–53 and 56–58. The centers of target greens 51–53 are placed generally along imaginary line 61 which is located on the portion of the playing field to the left of axis 18 on FIG. 1. The centers of target greens 56–58 are placed generally along imaginary line 63 which is located on the portion of the playing field to the right of axis 18.

The center of target green 51 is located about 110 yards forward of the teeing area 4 and approximately 50 yards left of the longitudinal axis 18. The center of target green 52 is located about 150 yards forward of the teeing area and approximately 40 yards left of the longitudinal axis. The center of target green 53 is located about 230 yards forward of the teeing area and approximately 30 yards left of the longitudinal axis. The center of target green 56 is located about 130 yards forward of the teeing area and approximately 60 yards right of the longitudinal axis. The center of target green 57 is located about 175 yards forward of the teeing area and approximately 40 yards right of the longitudinal axis. Finally, the center of target green 58 is located about 250 yards forward of the teeing area and approximately 40 yards right of the longitudinal axis. Located approximately on the longitudinal axis 18 are target green 54 which is situated about 75 yards forward of the teeing area and target green 55 which is situated about 140 yards forward of the teeing area. Located next to the edge of practice tees 10*b* in front of the trap, is target green 59. Finally, the center of the black or pitching green 26 is positioned about 30 to 40 yards ahead of the teeing area along the longitudinal axis 18.

At the foot of the course 20, adjacent to the bottom line border 10, is the teeing area 4, which is made up of three generally rectangular subdivisions 10*a*–10*c* of approximately equal size. Each of the subdivisions is completely covered with grass of a length commonly found on a conventional golf tee. The center rectangle, which has its longitudinal axis generally perpendicular to the longitudinal axis of the playing field 18, is designated the game tees 10*a*. The rectangles on either side of the center rectangle are each designated as practice tees 10*b* and 10*c*. Each of the tees 10*a*–10*c* contains a plurality of teeing locations or positions 50, where a player or group of players will hit their shots. The teeing locations are initially placed close to the edge of the teeing area next to the bottom line border 10. The teeing locations are then moved slightly forward a predefined amount each day or after several days. The objective of moving the locations daily is to allow the grass to regrow in the area previously used as the sites for teeing positions. When the sites for the prior teeing positions are replenished, the teeing positions may again be moved to the edge of the game teeing area adjacent the bottom line border 10 and the cycle of daily forward movement repeated. The distance of the move is kept to a minimum so that the distances to the fairway and target area are not substantially altered when the teeing positions are moved.

The sand trap 6, in an irregular circular or oval shape, is located a few yards left of the practice teeing area 10*b* and just behind target green 59. The putting green 8 is located a few yards right of the practice teeing area 10*c* and near bottom line border 10. In a preferred embodiment, the putting green 8 is located adjacent to the teeing area for convenience. It is contemplated that the putting green may be in alternative locations such as behind or within the areas designated as the tees 10*a*–10*c*.

Having described the inventive playing field, a preferred method of employing the field in a golf-like game will now be described.

Before active play of the game begins, each player selects the type of course they wish to play. In a preferred embodiment, four course lengths are available to suit the different skill levels of the player. The player may elect to play a Championship Course which is designated by yellow yardage marker 28*d*, a Blue Course which is designated by blue yardage marker 28*c*; a White Course which is designated by white yardage marker 28*b*; or a Red Course which is designated by red yardage marker 28*a*. The player's selection of which length course to play is governed in large measure by the strength and accuracy of the player's drives since penalty strokes, discussed hereinafter, are incurred if a player fails to reach the selected course length or drive balls out of the fairway.

All shots to the fairway 27, target green or pitching green are made from locations 50 on teeing area 4, with the exception of target green 59 corresponding to Holes 9 and 18, discussed hereinafter. Balls which are deflected after they land are always played to the advantage of the players, i.e., the player can choose the lie of the ball as either the point of deflection or the point where the ball comes to rest. When a ball is deflected in flight, the stroke is simply voided and another ball hit. The sequence of play among the players is governed by the rule of honors familiar to the standard game of golf. To summarize, honor is won by the player having the fewest number of strokes on a hole. The player having the honor is the first to tee off on the next hole. The order of play for the remaining players is also determined by the player's number of strokes on the prior hole. A player with fewer strokes precedes a player with a larger number of strokes. Honors for the first hole is determined by draw or agreement among the players.

Figure 2:
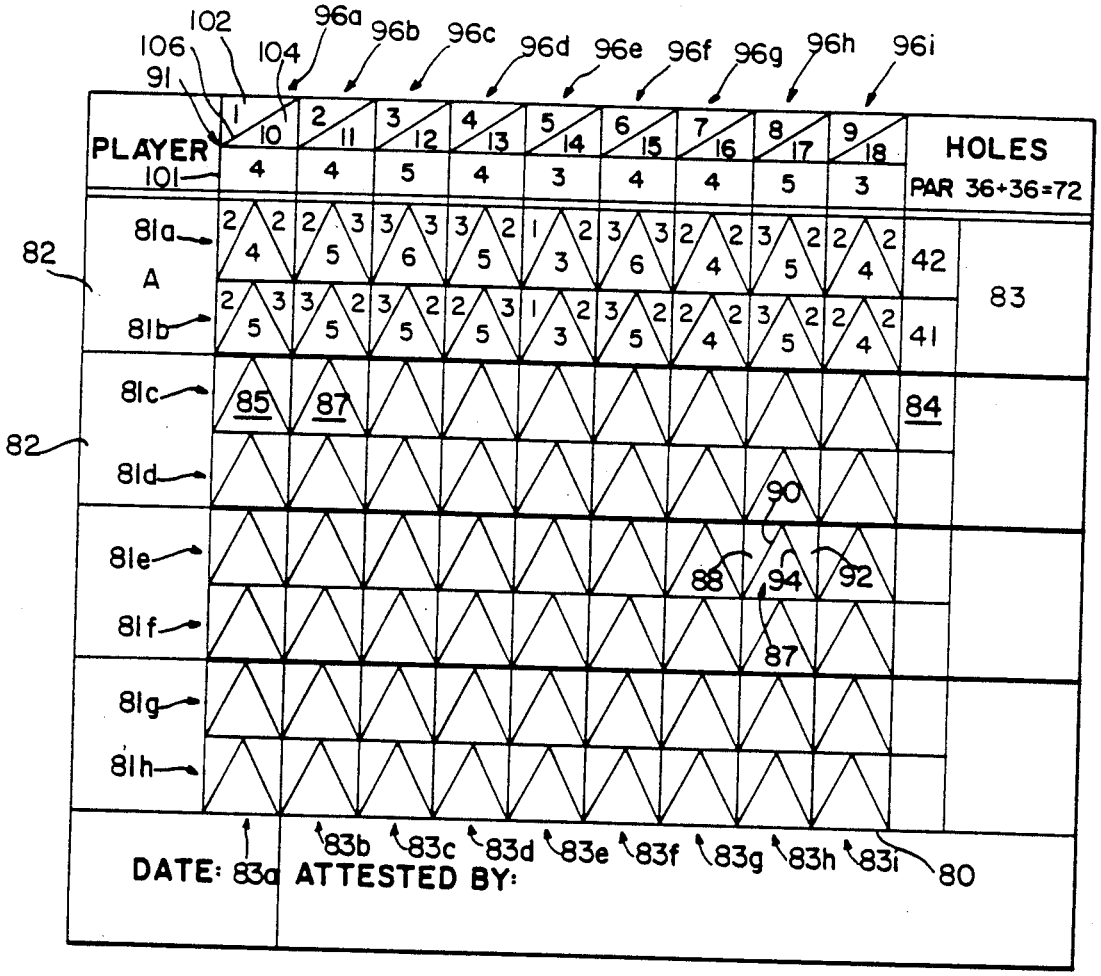
FIG. 2 is a diagram of a preferred embodiment of a scorecard used in practicing the method of the present invention.

FIG. 2 illustrates a preferred embodiment of a scorecard used to record the play of the game. The card basically comprises a square-like matrix 80 with eight horizontal rows 81*a*–81*h* and nine columns 83*a*–83*i*. The intersection of the rows and columns creates 72 squares 85. Each square is further divided into an equilateral triangle 87 whose legs are the same length as that of the square, a right triangle 88 which is adjacent to the left of the equilateral triangle and whose hypotenuse 90 is also a leg of the equilateral triangle 87 and a right triangle 92 which is adjacent to the right of the equilateral triangle and whose hypotenuse 94 is also a leg of the equilateral triangle 87.

A heading block 96*a*–96*i* is provided above each column 83*a*–83*i*. Each heading block is divided into two vertically arranged sections 91 and 101. Upper section 91 is further divided into two triangles 102 and 104 by diagonal line 106. Triangles 102 and 104 are used to designate the hole being played. Section 101 designates the par for the hole noted in both triangles 102 and 104. Using column 83*a* as exemplary, the score for Hole 1 is written in triangle 87 of row 81*a* with triangle 88 containing the number of strokes needed to reach a target green and triangle 92 containing the number of putts taken on the putting green to hole out. The same designations apply to triangles 87, 88 and 92 in row 81*b* for Hole 10. Thus, it can be appreciated that each player has two rows available for scoring with the first row used to score Holes 1–9 and the second row used to score Hole 10–18. As can be seen in FIG. 2, Holes 1 and 10 are par 4; Holes 2 and 11 are par 4; Holes 3 and 12 are par 5; Holes 4 and 13 are par 4; Holes 5 and 14 are par 3; Holes 6 and 15 are par 4; Holes 7 and 16 are par 4; Holes 8 and 17 are par 5; and Holes 9 and 18 are par 3.

Adjacent to the left of column 83*a* and under a heading designated "Player" are four equally sized squares or boxes 82 whose sides are twice as long as the sides of squares 85. This box clearly shows the player the two rows that are used to keep track of his score. Located below row 81*h* is a convenient area for date and attestation.

In using the card, the name of each player is placed in one of the boxes 82 under the heading designated "Player". The players' scores for Holes 1 through 9 are recorded in the squares to the upper right of the respective players' names. The players' scores for Hole 10 through 18 are recorded in the squares to the lower right of the players' respective names. To record the scores for each hole, the total number of strokes taken by the player before proceeding to the putting green is indicated in the left triangle 88 which is adjacent to the equilateral triangle 87. The total number of strokes taken on the putting green is indicated in the right triangle 92 which is adjacent to the right of the equilateral triangle 87. The sum total of the scores indicated in the two right triangles are indicated in equilateral triangle 87. To the right of each row, a box 84 is provided for the players to indicate the sum totals of all numbers written in the nine equilateral triangles found within that row. This figure represents the sum total of strokes taken to negotiate the holes designated by the squares located within that row, namely, Holes 1 through 9 for the row situated to the upper right of the player's name and Holes 10 through 18 for the row situated to the lower right of the player's name. Next to boxes 84 is a large square box 91 within which is recorded the 18 hole total. Once all scores have been tabulated by the players, the players insert the date of play where indicated on the scorecard and have one of the other players sign the scorecard in the rectangle labelled "Attested By".

A player begins the game by teeing up a ball in one of the locations 50 to play Hole 1. The player uses the same location to play all holes except Holes 9 and 18 which are played from sand trap 6 in a manner to be described hereinafter. Hole 1 is a par 4 hole and is accordingly played in the following manner. The player takes a golf ball, places it on a conventional wooden tee in the location 50 he has selected. The player then drives the ball to the course distance marker he selected at the start of the game. If the pre-selected distance marker is reached and the ball rests within the fairway (i.e., within the boundaries 41 and 42 marked by the line of the marker post), the player takes another ball, places it directly on the grassy surface area of location 50 and aims the ball for the target green 51 corresponding to Hole 1. If the ball comes to rest on target green 51, the player places his score (2) into the proper triangle 88 on the scorecard. If, however, the target green corresponding to Hole 1 is missed, the player places another ball directly on the grass of location 50 and hits the ball from location 50 to the black green 26, which acts as a pitching green. The player continues to hit balls in this manner until a ball comes to rest on the black green. Each time the player addresses and hits a ball, he incurs a stroke and scores accordingly.

If the player's initial shot or tee-off fails to reach the colored distance markers or is out of the fairway 27 (i.e., wide of the posts 41 and 42), the player incurs a one stroke penalty. Play then proceeds as before with the player aiming at the designated target green 51. The use of the penalty stroke is an effort to even out the differences between the present inventive game and a regular game of golf. For the example just described, at least one stroke would be lost in returning to the fairway of a regular golf course.

After play on Hole 1 has concluded, the player enters his score in the manner previously described with reference to FIG. 2. The player then proceeds to Hole 2 which is also a par 4 hole and is therefore played in the same manner and according to the same rules as Hole 1. The only exception is that instead of hitting the second shot to target green 51 area corresponding to Hole 1, the player hits the second shot to target green 52 corresponding to Hole 2. As can be appreciated, all par 4 holes are played the same way, the only difference being the target green employed. It should be noted here, that as of yet, there has been no putting as this is done after all tee-to-green play for nine (or 18) holes has been completed.

The player then proceeds to play Hole 3. Hole 3 is a par 5 hole and, in a preferred embodiment, is played in the following manner. The first player takes a golf ball and places it on a wooden tee in the location 50 used previously for Holes 1 and 2. The player drives the ball to the course distance marker selected at the start of the game. If this marker is reached and the ball rests within the fairway, the player takes another golf ball and places it on the grass in location 50. The player then hits the ball to target green 53 corresponding to Hole 3. If the ball rests on this target green, the player places his score for that hole on the designated area of the scorecard. When he eventually proceeds to the putting green after nine (or 18) holes played tee-to-green, he will be putting for an eagle. If target green 53 is missed, the player's next ball would be placed on the grass in location 50 and hit from the game teeing area to the black green 26. The player continues to place a ball in the game teeing area and to hit it from location 50 to the black green. Each stroke is counted until a ball hit from the game teeing area comes to rest on the black green. Once a ball rests on the black green, the player adds up all strokes and scores accordingly. Thus, if the initial shot (drive) on the par 5 hole is accurate and long enough, the play proceeds exactly as for a par 4 described above.

However, if the player's first shot on Hole 3 from the game teeing area to the pre-selected course distance marker rests short of the course distance marker or is out of the fairway boundaries, the sequence of play is altered. For the player's second shot another ball is placed on the grass at location 50 and again hit to the distance course marker. This time the ball is unteed. The third shot is played directly to the pitching green 26, bypassing the target green, until this pitching green is held as described above. The player, therefore, has the opportunity to play tee-to-green in 3 strokes in this manner despite an errant first shot. However, if the second fairway shot is again short and/or wide of the fairway, a penalty stroke is added to that player's score and he or she will be playing to the pitching green lying 3.

Alternations to the preferred method of playing a par 5 hole are contemplated. For example, if a player's first shot reaches the course distance marker but lands outside the fairway, the sequence of play remains the same as that discussed immediately above, namely as if the first shot was within the fairway. However, a one stroke penalty is added to the player's score so that the second shot from the game teeing area to the target area corresponding to Hole 3 is deemed to be the player's third shot.

As a further alternative, if the player's first shot from the game teeing area to the pre-selected course distance marker rests short of the course distance marker or is out of the fairway boundaries, the sequence of play can be altered. For the player's second shot another ball is placed on the grass at location 50 and again hit to the distance course marker. This time the ball is unteed and a one stroke penalty is added to the player's score. If the ball reaches the course distance marker, the player proceeds in the same manner as if the first shot had reached the course distance marks. However, should the ball again rest short of the course distance marker and/or if it rests outside of the fairway, a second penalty stroke would be added to the player's score.

Hole 4 is a par 4 hole which is played in the same manner as that discussed above for Hole 1. The exception is that instead of playing from the game teeing area to the target green 51 corresponding to Hole 1, the player directs the second shot to target green 54 corresponding to Hole 4.

Hole 5 is a par 3 hole which is played in the following manner. The player takes a golf ball and optionally places it on a tee or on the grass of location 50 in the game teeing area and hits the ball toward target green 55 corresponding to Hole 5. If the ball rests on the target green, the player enters his score on the scorecard. If the target area corresponding to Hole 5 is missed, the player's next ball is placed on the grass of location 50 in the game teeing area and hit from the game teeing area to the black green 26. This latter scenario is repeated until a ball hit from the game teeing area to the black green rests on the black green. Each stroke is counted and added to the player's score.

Hole 6 is a par 4 hole which is played in the same manner as Hole 1 except that instead of playing from target green 51, the player will hit the second shot to the target green 56 corresponding to Hole 6.

Hole 7 is a par 4 hole which is played in the same manner as Hole 1 except that instead of playing from the game teeing area to target green 51, the player will hit the second shot to target green 57 corresponding to Hole 7.

Hole 8 is a par 5 hole which is played in the same manner as Hole 3, except that instead of playing to target green 53 corresponding to Hole 3, the players will play to target green 58 corresponding to Hole 8.

Hole 9 is played unlike all prior holes thus far discussed. The player takes a golf ball and places it within the sand trap 6 rather than in the game teeing area 4. The player's first shot is a short sand shot hit from the front portion of the sand trap located near target green 59, corresponding to Hole 9. If the ball rests on the target green, the player score his card accordingly by entering a 1 into triangle 88. If the green is missed, then the sequence is repeated until the green is held and all strokes are counted and added to the scorecard.

Once the player has completed Hole 9, the entire course is in effect repeated for Holes 10 through 18. The method of playing Holes 10 through 18, including the target corresponding to these holes, is respectively the same as previously discussed for Holes 1 through 9, with one exception. Of special interest is the preferred method of playing Hole 18. Hole 18 is played in the same manner as Hole 9 except that the player's first shot is a bunker shot hit from the back of the sand trap to the target area corresponding to Hole 9. This shot is played from a dropped position, rather than a placed position.

All of the putting is done at the end of tee-to-green play, either after nine or 18 holes. Thus, when a player finishes playing tee-to-green for nine holes, the player walks to the putting green 8 where putting for nine holes will be done on the green. The green has nine cups 111, optionally with flags 112, and the player advances one through nine on the putting green. The player is required to place the ball behind the cup previously played and putt to the next hole. Optionally, there may be more specific areas designated on the putting green for placement of the ball and the player will have some freedom in placing his ball near and behind the cup previously played. Doing all of the putting at one time is an important concept because it will cut down on the traffic and time to play the round and also concentrates a player's efforts to help improve his game. Thus, a player or team of players will play to the green for nine holes, then go as a unit to the putting green for finishing the nine holes. If 18 holes are to be played, then they will return again and repeat the sequence. They will, therefore, move from the teeing area to the putting green and back, only twice in the entire 18 holes (or even only once, if 18 holes, tee-to-green are played consecutively).

As each hole is putted on the putting green, the number of strokes needed to hole-out are recorded in triangle 92 of the scorecard in the manner described hereinbefore.

Many changes and modifications in the above embodiments of the invention can be made without departing from the scope of the invention. For example, more than one fairway, putting green or teeing area, in a variety of arrangements might be used to accommodate large numbers of players without departing from the concepts of the present invention. In addition, within the spirit of the invention, the course could be constructed to have holes with the same par, for example, all par 3. Accordingly, the scope is intended to be limited only by the appended claims.

What is claimed is:

1. A playing field on which a golf-like target game is played, said field comprising:

an elongated course of predetermined length and width;

a plurality of teeing locations positioned next to each other at one end of said course and constituting teeing means;

a plurality of target greens positioned on said course each of said greens being a predetermined distance from said teeing means, each of said greens forming part of a hole to which a par value of 3, 4 or 5 has been assigned, said target greens for par 5 holes being located farther away from said teeing means than said target greens for par 4 holes;

at least one dedicated pitching green located at a predetermined distance from said teeing means, said pitching green being closer to said teeing means than either said target greens for par 4 holes and said target greens for par 5 holes; and a plurality of uniquely colored yardage markers, each of said markers being positioned progressively at greater distances from said teeing means.

2. The playing field of claim 1, further comprising at least one putting green located adjacent said teeing means.

3. The playing field of claim 1, wherein said at least one pitching green is closer to said teeing means than the target greens for par 3 holes.

4. The playing field of claim 1, further comprising a sand-hole target green positioned adjacent said teeing means and a sand trap adjacent said sand-hole target green.

5. The playing field of claim 1, further comprising an elongated fairway defined along a portion of the longitudinal axis of said course and wherein there are four of said uniquely colored yardage markers, with each marker being positioned along the longitudinal axis of said fairway.

6. The playing field of claim 5, wherein said first marker is red and is located closest to said teeing means, said fourth marker is yellow and is located farthest from said teeing means, said second marker is white and is located between said yellow and red markers and said third marker is blue and is located between said yellow and white markers.

7. The playing field of claim 6, wherein said first and fourth markers define the beginning and end boundaries, respectively, of said fairway.

8. The playing field of claim 7, wherein each of said yardage markers is a predetermined length and is arranged generally perpendicular to the longitudinal axis of said course, the ends of said yardage markers being arranged in a line generally parallel to said longitudinal axis of said course and defining left and right boundaries of said fairway.

9. The playing field of claim 5, wherein said target greens are positioned away from said yardage markers.

10. The playing field of claim 1, wherein the number of target greens in said plurality corresponds to one-half the number of holes constituting a single game.

11. The playing field of claim 10, wherein said number of target greens is 9 and the number of holes is 18.

12. The playing field of claim 2, wherein said at least one putting green includes a number of spaced holes, the number of holes corresponding to the number of target greens.

13. A playing field on which a golf-like target game is played, said field comprising:

an elongated course of predetermined length and width;

a plurality of teeing locations positioned next to each other at one end of said course and constituting teeing means;

an elongated fairway defined along a portion of the longitudinal axis of said course and wherein there are four uniquely colored yardage markers, with each marker being positioned along the longitudinal axis of said fairway;

a plurality of target greens positioned on said course each of said greens being a predetermined distance from said teeing means and being outside of said fairway, each of said greens forming a hole to which a par value has been assigned; and a dedicated pitching green located at a predetermined distance from said teeing means, said pitching green being closer to said teeing means than all of said target greens.

14. The playing field of claim 13, further comprising a sand-hole target green positioned adjacent said teeing means and a sand trap adjacent said sand-hole target green.

15. The playing field of claim 13, wherein said first marker is red and is located closest to said teeing means, said fourth marker is yellow and is located farthest from said teeing means, said second marker is white and is located between said yellow and red markers and said third marker is blue and is located between said yellow and white markers.

16. The playing field of claim 15, wherein said first and fourth markers define the beginning and end boundaries, respectively, of said fairway.

17. The playing field of claim 16, wherein each of said yardage markers is a predetermined length and is arranged generally perpendicular to the longitudinal axis of said course, the ends of said yardage markers being arranged in a line generally parallel to said longitudinal axis of said course and defining left and right boundaries of said fairway.

18. The playing field of claim 13, wherein the number of target greens in said plurality corresponds to one-half the number of holes constituting a single game.

19. The playing field of claim 18, wherein the number of target greens is 9 and the number of holes is 18.

* * * * *